United States Patent [19]

Stephens

[11] 4,075,933

[45] Feb. 28, 1978

[54] HYDRAULIC PUMP OR MOTOR

[75] Inventor: William T. Stephens, New Brighton, Minn.

[73] Assignee: Gresen Manufacturing Company, Minneapolis, Minn.

[21] Appl. No.: 693,017

[22] Filed: Jun. 4, 1976

[51] Int. Cl.[2] ..... F01B 13/04

[52] U.S. Cl. ..... 91/506

[58] Field of Search ..... 91/499–507; 417/222, 269

[56] References Cited

U.S. PATENT DOCUMENTS

| | | | |
|---|---|---|---|
| 1,659,374 | 2/1928 | Robson | 91/505 |
| 2,157,692 | 5/1939 | Doe et al. | 91/499 |
| 2,371,974 | 3/1945 | Neuland | 60/492 |
| 3,108,543 | 10/1963 | Gregor | 91/505 |
| 3,149,577 | 9/1964 | Gregor | 74/60 |
| 3,382,813 | 5/1968 | Schauer | 91/506 |
| 3,585,901 | 6/1971 | Moon, Jr. | 91/499 |
| 3,761,202 | 9/1973 | Mitchell | 417/269 |
| 3,796,137 | 3/1974 | Thoma | 91/489 |

FOREIGN PATENT DOCUMENTS

| | | | |
|---|---|---|---|
| 1,321,301 | 2/1963 | France | 91/505 |
| 1,900,965 | 6/1970 | Germany | 91/499 |
| 1,161,762 | 1/1964 | Germany | 91/507 |

*Primary Examiner*—William L. Freeh

*Attorney, Agent, or Firm*—Merchant, Gould, Smith, Edell, Welter & Schmidt

[57] ABSTRACT

A fluid pressure device comprising a pump or motor having a rotating internal assembly comprising linear pistons and cylinders operated through a "swash" plate to actuate the pistons to provide output pressure. The swash plate is mounted to the drive shaft through a universal connection and the cylinder and piston assemblies are coupled to their component parts through universal swiveling ball and socket connections. Special spring washers are provided for insuring a sliding seal between the internal cylinders and a valving plate, and the valve ports are designed for noise minimization.

15 Claims, 7 Drawing Figures

FIG. 5
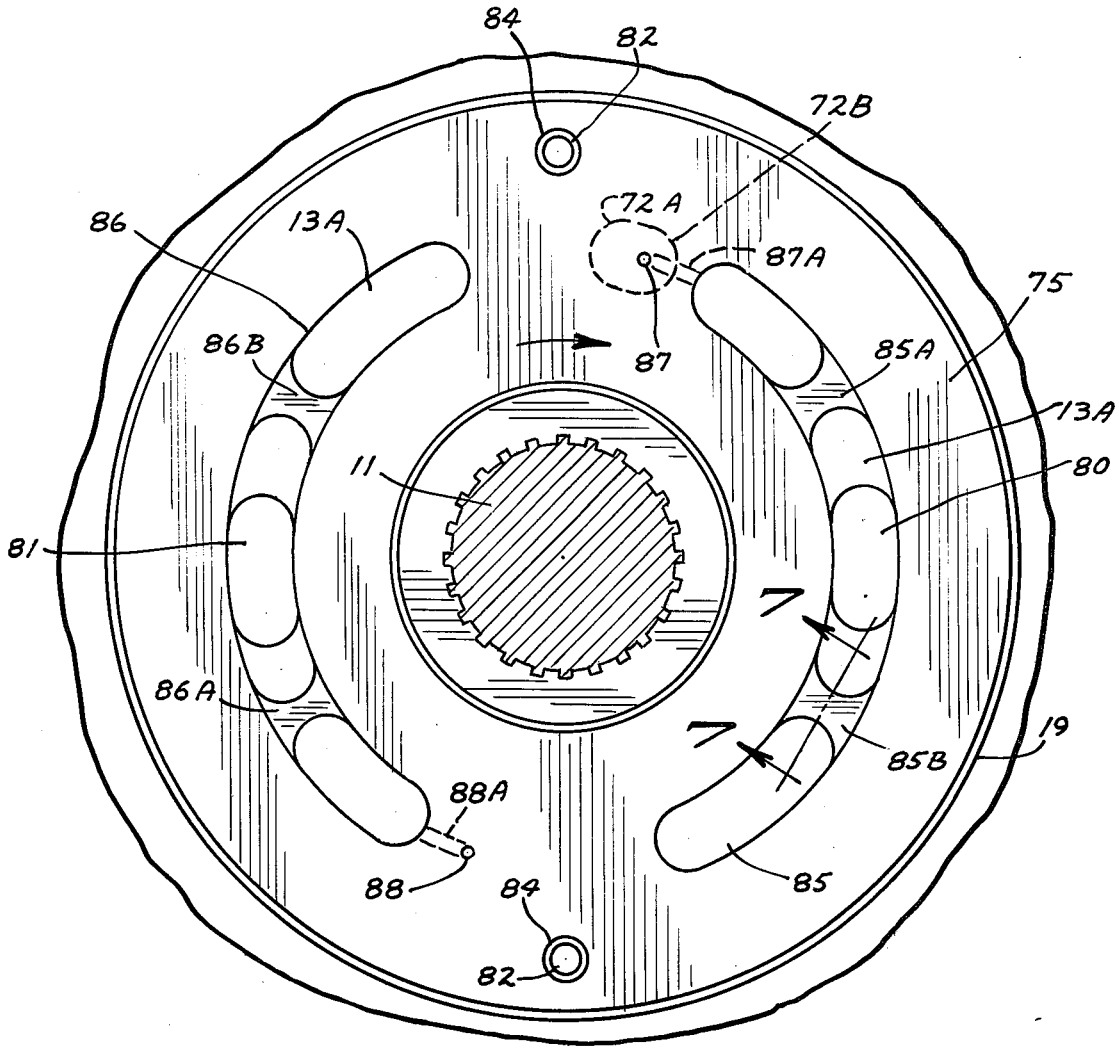
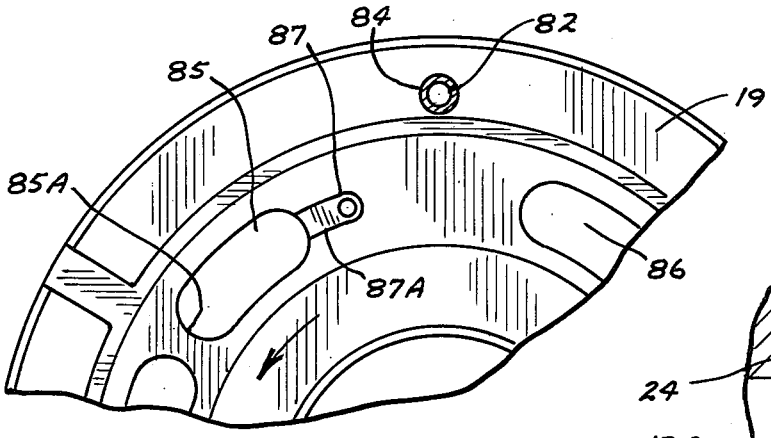
FIG. 6
FIG. 7
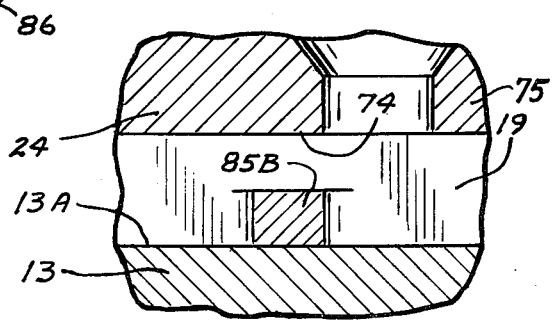

HYDRAULIC PUMP OR MOTOR

BACKGROUND OF THE INVENTION

1. Field of the Invention

The present invention relates to fluid pressure devices which can be used either as pumps or motors.

2. Prior Art

Various fluid devices utilizing a swash plate principle of actuation have been advanced. Some of these have attempted to provide load reducing couplings for the pistons and the cylinders. Examples of such connections are shown in U.S. Pat. Nos. 2,157,692 to Doe et al; 3,245,354 to Gregor; and 2,146,133 to Tweedale.

U.S. Pat. No. 3,479,963, issued to Randa et al, and U.S. Pat. No. 3,246,577 issued to MacIntosh show devices for resiliently biasing a rotating cylinder carrier against a valving surface.

Other swash plate fluid devices have mounted the plates on the shafts with limited pivotal movement being provided. Examples of this type of drive for the variable cam or swash plate are shown in U.S. Pat. Nos. 2,095,316 issued to Davis; 1,118,799 issued to Prott; and 3,319,874 issued to Welsh et al. Further showings occur in U.S. Pat. Nos. 2,465,510 issued to Bonnafe; 3,292,554 issued to Hessler; and 2,231,100 issued to Wahlmark.

Additionally, U.S. Pat. No. 2,661,695 discloses, in FIGS. 3 and 6, an arrangement for minimizing noise by precharging or prefilling the cylinders as the units are rotated from the low to the high pressure ports. However, a very complex arrangement is disclosed to accomplish this end, and the structure is much different from that utilized in the present device. U.S. Pat. No. 3,699,845, issued to Ifield, shows a pump which has a port plate that has small passageways which are used to avoid rapid changes in pressure in the passageways associated with the port as the pump is operated. The small passageways permit limited flow before full communication of the ports and associated passageways.

SUMMARY OF THE INVENTION

The present invention relates to a fluid device that can be used as a pump or motor and which includes a rotating shaft carrying a plurality of piston pumps mounted on a "swash" plate control. A control cam can be changed in inclination relative to the axis of rotation of the shaft to cause greater or less actuation of piston type pumps carried by the swash plate. Each of the piston pumps comprises a piston slidably mounted in its respective cylinder. The cylinders are mounted in a cylinder carrier that rotates with the shaft and which has universal swiveling ball sockets for mounting ball ends on the cylinders to the carrier. Likewise, the pistons, which are mounted to the cam plate, are mounted in a universally swiveling ball and socket arrangement so that when operated, the pistons and cylinders will not tend to bind, and will easily accommodate different adjustments.

The cam operated plate carrying the pistons is mounted on the shaft through thrust bearings to carry thrust loads.

The cylinder carrier has separate ports thereon open to each of the cylinders and these ports will alternately communicate with one of a pair of inlet and outlet ports, respectively formed in a valve plate, against which the cylinder carrier rotates. The noise normally associated with this type of fluid device is also minimized by providing means for opening the cylinders and pistons to a restricted passageway leading to the high pressure ports prior to the time they are fully opened to the high pressure port so that violent changes in pressure are avoided.

The major thrust loads are carried by a thrust bearing from the shaft mounting the piston pumps to the housing to minimize the likelihood of wear.

Resilient spring washers are used between each of the cylinders and the cylinder carrier to provide a resilient force urging the cylinder carrier against the valve plate and thus exert a sealing force that will compensate for slight wear to minimize problems with excessive leakage from minor wearing of parts.

DESCRIPTION OF THE DRAWINGS

FIG. 5 is a sectional view taken along the line 5—5 in FIG. 2;

FIG. 6 is a fragmentary view taken along line 6—6 in FIG. 2; and

FIG. 7 is a fragmentary sectional view taken on line 7—7 in FIG. 5.

DESCRIPTION OF THE PREFERRED EMBODIMENT

A fluid power device comprising a fluid pump or motor is illustrated generally at 10. If the fluid device is to be operated as a pump, a shaft 11 is driven from a power source, and serves to drive the pump components, while if it is to be used as a motor, the shaft 11 would be the power output shaft and fluid under pressure will be provided to the motor to drive the device in opposite operation from that which is described herein.

For sake of explanation, the present discussion will describe the operation as a pump. The mechanism, as is well known, can operate in either manner.

Figure 2:
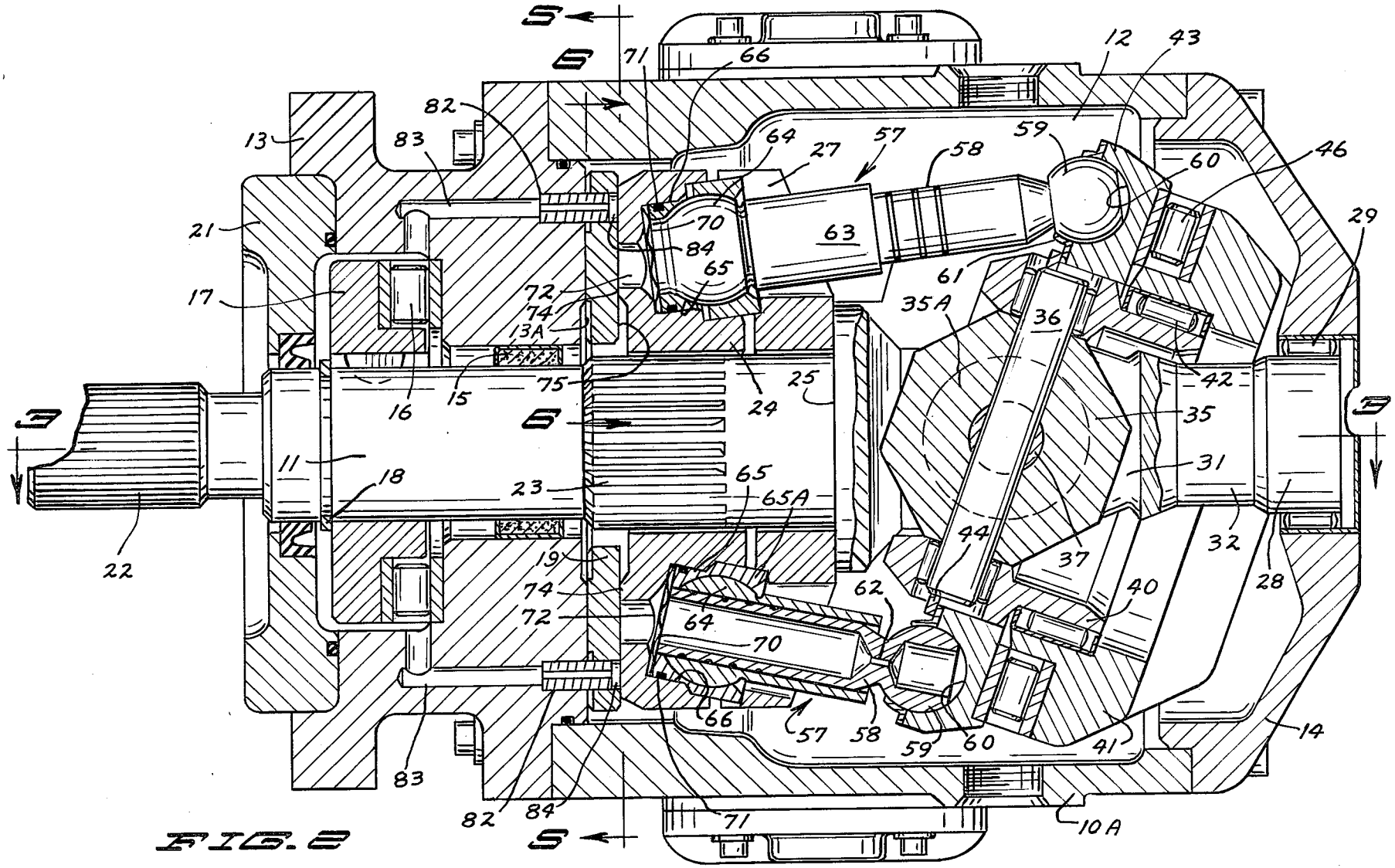
FIG. 2 is a sectional view taken as on line 2—2 in FIG. 1.
Figure 3:
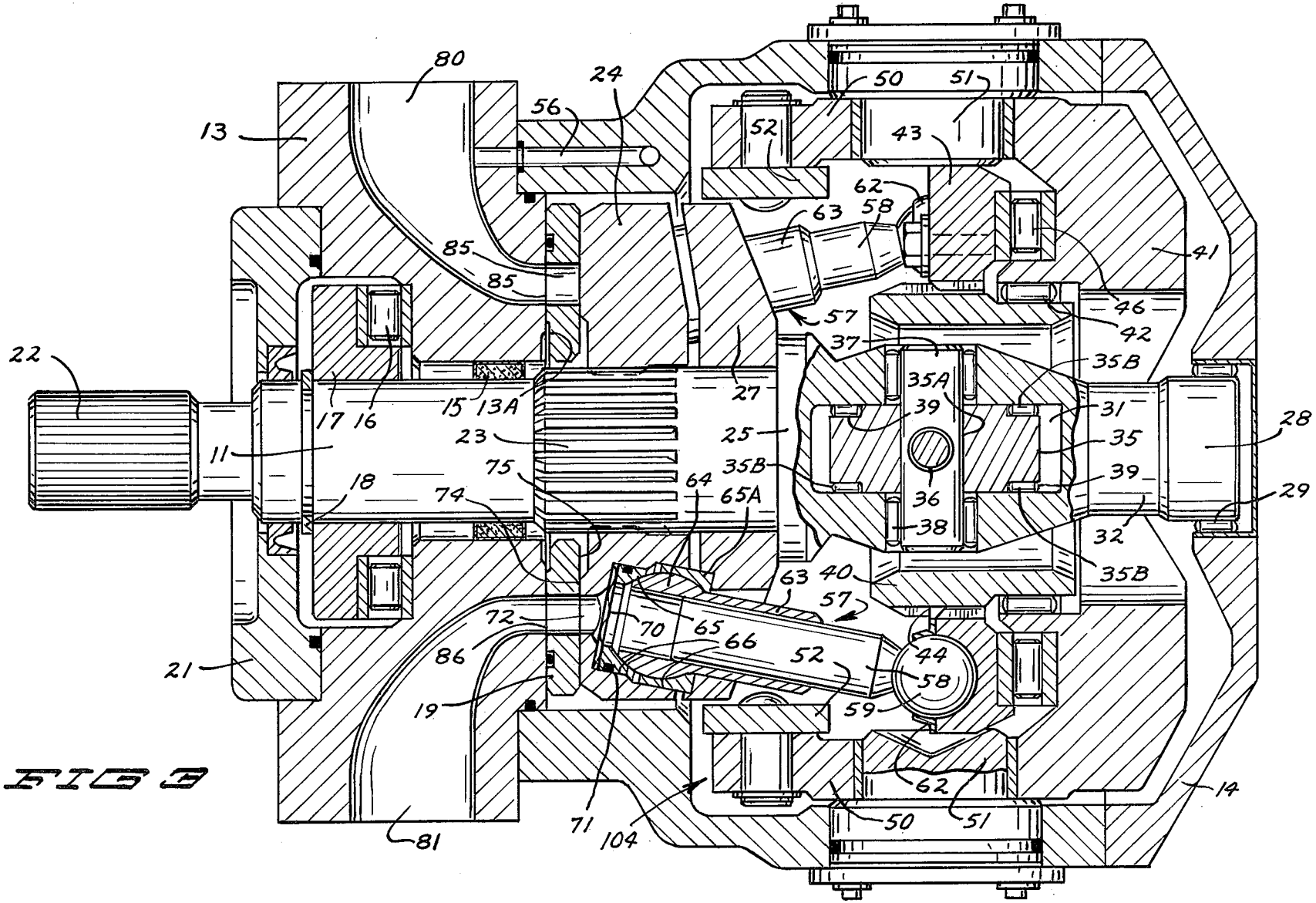
FIG. 3 is a sectional view taken as on line 3—3 in FIG. 2.

The pump or motor 10 as shown has an outer main housing 10A which, as can be seen in FIGS. 2 and 3, has an interior chamber 12. The chamber 12 is closed with a port block 13 at one end thereof, and an end cap 14 at the opposite end. The port block 13, as shown in FIG. 3, mounts a bearing 15 for the shaft 11 which extends through the port block. A thrust bearing 16 is positioned between a collar 17 and a radial surface formed in a recess in the port block 13. The collar 17 also fits within the recess, and is driven with the shaft through a key and is held axially on the shaft with suitable snap ring 18. A seal holder cap 21 can be mounted on the port block and used for mounting a seal for the shaft 11.

The shaft 11 as shown has an external splined end portion 22 for driving (power output or input), and an intermediate spline 23 is also formed on shaft 11 toward the interior chamber 12 of the housing 10A from the port block 13. The spline 23 drivably mounts an internally splined cylinder carrier ring 24. The cylinder carrier ring 24, as will be more fully explained, bears against the interior surface of a valve port plate 19 which in turn bears against a surface 13A of the port block 13.

A shoulder 25 is formed on the shaft 11 and a cylinder seat retaining ring 27 is seated against the shoulder 25.

The shaft 11 has an opposite end portion 28 that is rotatably mounted in a bearing 29 in the end cap 14. The shaft 11 has a slot formed therein as shown at 31 between shoulder 25 and end 28, which is best seen in FIG. 3. The shaft 11 also has a reduced diameter section 32 which is turned down to provide clearance for pivoting the "swash plate", as will be explained. A disk member 35 has central portions 35A that slidably fit within the slot 31. The disk 35 has a pair of annular surfaces 35B adjacent its outer edges, and thrust bearings 39 are mounted on these surfaces and engage the sides of slot 31.

The disk 35 is mounted on a cross pin 37 that is perpendicular to the plane of the disk 35 and extends into provided cross holes in the shaft 11. The pin 37 is mounted in bearings 38 in the cross holes in shaft 11 (FIG. 3).

The disk member 35 has an opening therethrough having an axis centered on the central plane of the disk. A pin 36 is mounted in this opening in the disk and extends outwardly from the edges of the disk member 35. The pin 36 is smaller in diameter than pin 37 and also passes through an opening in pin 37. As shown in FIG. 2, the ends of pin 36 which extend beyond the disk 35 drive a hub 40 which surrounds the shaft 11 and which rotates with the shaft 11. The ends of pin 36 are mounted in suitable bearings carried by the hub.

A nonrotating pivoting housing member 41 has an open center surrounding shaft 11 and a bearing 42 is mounted therein. One end of hub 40 is rotatably mounted in bearing 42. The pivotal mounting of the housing 41 to the main housing 10A will be subsequently more fully explained. A piston mounting ring or piston carrier 43 is internally splined and drivably mounts over splines on the periphery of the hub 40. The piston carrier 43 encircles the hub 40 and thus overlies both ends of the pin 36. A snap ring 44 is used for removably holding the piston carrier 43 in place on the hub 40. A thrust bearing 46 is positioned between an end surface of the piston carrier 43 and the housing 41. Thus it can be seen that the disk 35, the pin 36 which it carries, the hub 40 and the piston carrier 43 will all rotate with the shaft 11, and because of the mounting through the bearings 42 and 46, these members may rotate with respect to the housing 41. The assembly just described comprises the swash plate for controlling pump output.

The hub 40 and therefore the piston carrier 43 are universally coupled to the shaft 11. The disk 35 and hub 40 may pivot about the axis of pin 37, and the hub 40 may also pivot about the axis of pin 36. The main adjustment of pump output is accomplished by the pivoting about pin 37, while the ability to pivot about pin 36 permits movements to compensate for small misalignments and the like.

Referring specifically to FIG. 3, it can be seen that the cam or swash plate housing 41 has side support members 50 formed integrally therewith. These side plates 50 are mounted through bushings to suitably pivot pins 51, fixed to opposite sides of the housing 10A. The pins 51 form pivots for the swash plate housing 41 which permit it to pivot about an axis which is substantially coincidental with the axis of pin 37 and which passes through the axis of rotation of the shaft 11 at right angles thereto.

Figure 1:
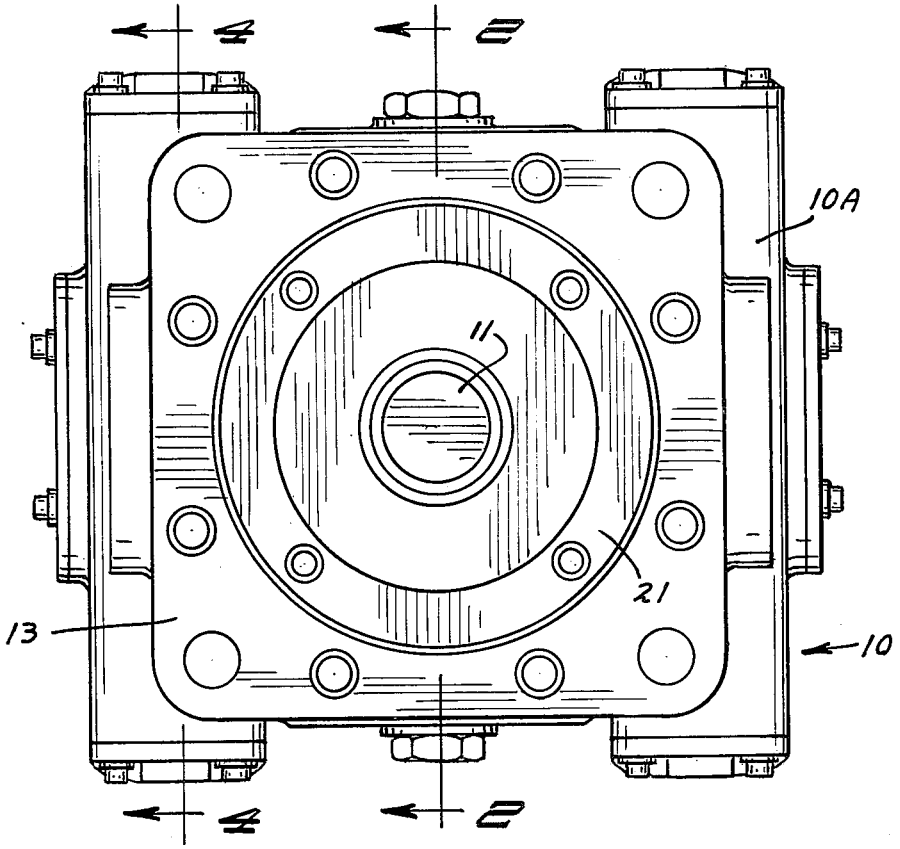
FIG. 1 is an end view of a fluid device made according to the present invention.
Figure 4:
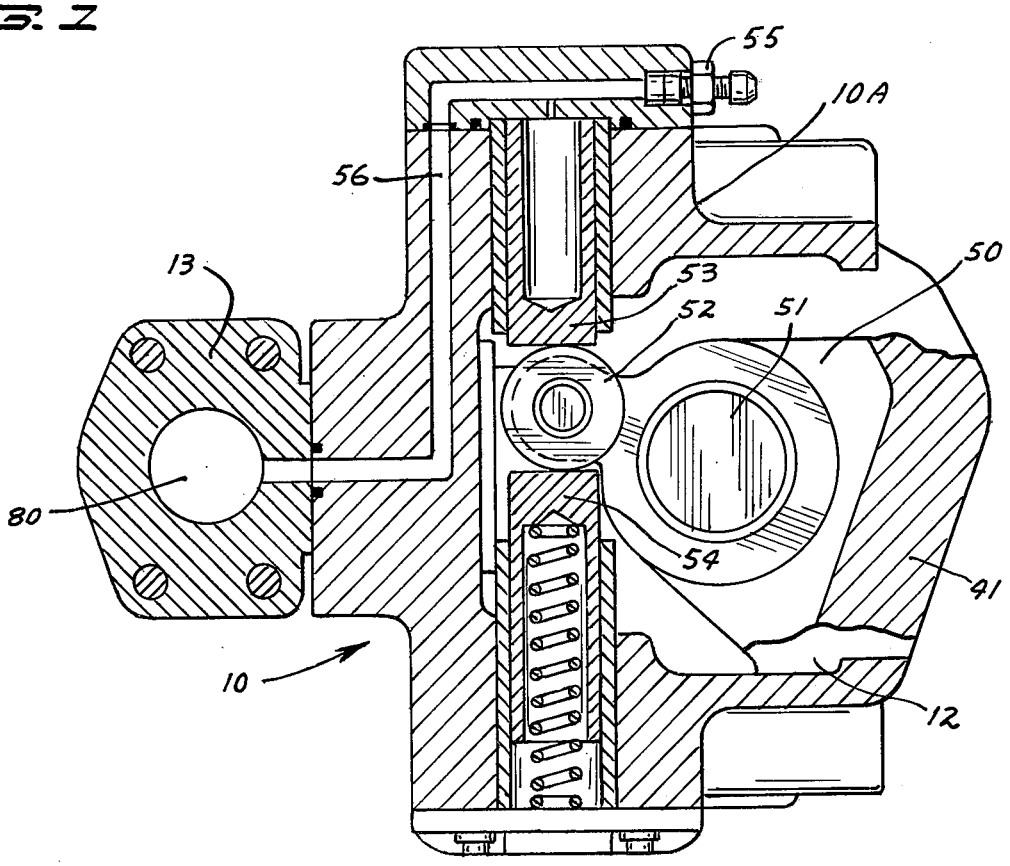
FIG. 4 is a sectional view taken as on line 4—4 in FIG. 1.

The side members 50 further have swash plate adjustment rollers 52 mounted therein, which adjustment rollers are on opposite sides of the chamber 12, and which are controlled by the use of small hydraulic pistons as shown at 53 in FIG. 4, acting against spring loaded piston members 54 on the opposite side of the respective rollers. The pressure on the pistons may be derived by adjusting a relief valve 55 which controls bypass of fluid under pressure from a pressure passageway 56 leading from the pressure port. The pistons 53 on both sides of the unit may be controlled by a common pressure supply in a known manner. The spring pistons will tend to bias the swash plate assembly to maximum output. The balancing pressure on piston 53 modulates the output in accordance with the desired adjustment.

The device for adjusting the angle of the swash plate housing 41, and thus also the angle of the hub 40 and piston carrier 43, about the axes of the pins 51 and 37 are not shown in detail because it does not form a part of the invention. Mechanical adjusting devices can be utilized if desired, or other known forms of adjusting devices can be used so that the displacement of the pump can be varied by changing the angle of the swash plate assembly and thus changing the rotational plane of the piston carrier 43 with respect to the axis of the shaft 11.

The pump utilizes a series of individual linear piston pump assemblies indicated generally at 57 (FIGS. 2 and 3) for providing fluid power. Each of the pump assemblies includes a piston 58, which as shown has a part spherical end member 59 that is seated in a part spherical seat indicated generally at 60 on the piston carrier 43. In the form of the invention shown there are seven such linear pump assemblies 57, and thus there are seven hemispherical seats 60 defined in the piston carrier ring 43, for the seven pistons 58. The part spherical or ball member ends 59 are each held in place with a suitable retaining member 61 that keeps the respective end 59 seated in the hemispherical surfaces 60. The retainer 61 can be held in place on the piston carrier 43 with small cap screws.

The pistons 58 each comprise an elongated cylindrical tubular member that has an end orifice passageway 62 that leads to and opens to the end of the respective ball member 59. It should also be noted that the outer end of the ball members 59 are flattened off so that there is a pocket formed between the end of each ball member and its seat 60. The passageway 62 serves to provide lubrication for the ball member in its hemispherical seat by permitting fluid under pressure to bleed to the seat 60 through the restricted orifice.

The outer surfaces of the piston members are cylindrical and they are slidably disposed within an interior chamber or opening of corresponding cylinder members 63. There are seven of the cylinder members 63 in the fluid device. The ends of the cylinder members opposite from the pistons 58 have end portions 64 that have part spherical outer surfaces of larger diameter than the main portion of the cylinders. The part spherical outer surfaces of the ends 64 are seated against washer-like seats 65 which in turn are mounted into individual receptacles 66 on the cylinder carrier 24. A corrugated or wavy spring washer or other suitable bias means indicated generally at 70 is positioned between the end surface of each receptacle 66 and the respective seat 65. The cylinder seats are sealed with a suitable seal 71 to the outer surface of the receptacle 66. The cylinder ends 64 are held against the seats 65 by retainers 65A which are suitably located partially in receptacles in the carrier 24 and also in the retainer ring 27. The retainer 27 is held against shoulder 25.

Each of the cylinders opens to a port 72 which faces the valve plate 19. The end surface of the cylinder carrier 24 indicated at 74 seats against a complementary surface 75 on the valve plate 19. The cylinders 63 are therefore held in the seats 65 and retainer 65A by the ring 27 held by shoulder 25. Force is reacted through shaft 11, snap ring 18, collar 17, and thrust bearing 16 to port block 13. The reactive force from the cylinders is carried by wavy washers 70 to carrier 24 and then to plate 19 and to port block 13. The cylinder carrier 24 rotates relative to valve plate 19 during operation so a sliding seal is necessary between the two mating surfaces. The force with which these two surfaces contact must be controlled and the wavy washers aid in regulating the sealing force.

The retainer ring 27 has openings through which the cylinders 63 extend and the openings permit the cylinders 63 to tilt or swivel a limited amount in seats 65 and retainers 65A during use without interfering with the retainer ring 27.

Referring now specifically to FIGS. 3 and 5, it can be seen that the port block 13 has a first port 80, comprising a pressure port, defined therein, that leads to the exterior of the pump or motor and also has a port 81 defined therein which comprises a return or intake port. The ports 80 and 81 are shown open on opposite sides of port block 13 and curve toward and open to the surface 13A. The valve plate 19 rides against surface 13A and has part annular (kidney shaped) ports defined therethrough spaced radially to be in alignment with the ports 80 and 81. The valve plate 19 is held from rotating relative to port block 13, by the use of tubular spring pins 82 which project partially into openings 84 in the valve plate 19. The passageways 83 provide drainage to and from the cavity in valve block 13 in which bearing 16 is mounted and also insure lubrication of the bearing.

Referring specifically to FIG. 5, which provides an end view of the valve plate 19, looking at it in a direction from the cylinder carrier 24 toward the valve plate, a part annular, slot-like valving port, which is indicated generally at 85, is positioned so that it is open to the pressure port 80. The valving port 85 extends through the plate 19 in a part annular path starting at about 26½° from a vertical center line, and terminating clockwise approximately 16½° from the vertical center line at its lower end.

A part annular port 86 comprising the intake valving port as shown starts at its lower end approximately 26½° from the vertical center line, and terminates in clockwise direction at its upper end approximately 16½° from the vertical center line. The valving port 86 in the valve plate 19 is open to the intake port 81, as also shown in FIG. 5.

The valve plate 19 is provided with a small opening 87 through the plate adjacent to the rotationally leading end of the valving port 85, that is, with the shaft 11 rotating clockwise as shown by the arrow in FIG. 5, and also a small opening 88 is provided adjacent the rotationally leading end of the valve port 86. The opening 87, as can be seen in FIG. 6, is fluidly connected with a small recess or slot 87A to the end of the port 85. This recess 87A is typical, and a similar recess 88A is provided connecting the lower opening 88 to the port 86. Recess 88A is shown in dotted lines in FIG. 5. The recesses 87A and 88A are closed on one side by surface 13A.

The ports 85 and 86 are divided with port bars 85A and 85B, as well as port bars 86A and 86B. These port bars are for strength purposes, and as can be seen typically in FIG. 7, they do not divide the ports into chambers, in that the bars are recessed below the general plane of the surface 75 of the valve plate 19 in contact with the cylinder carrier. Pressure in one portion of the port 85, for example, will be present in all portions of the port, and likewise the fluid pressure in any portion of the port 86 will be the same in other portions of the port 86 throughout its arcuate length.

Assuming that the shaft 11 is rotating in a clockwise direction as viewed in FIG. 5 and shown by the arrow, and with the swash plate assembly in the position as shown in FIG. 2, when the individual pump assemblies are at a top of their cycle, that is, the reference piston is nearly centered on the vertical center line shown in FIG. 5 and up near the top of the valve plate 19, that piston will be expanded from its cylinder a maximum amount and will have been charged with fluid from the intake valving port 86. The reference pump will have been in communication with port 86 and the port 72 will be sealed on surface 75, as shown in FIG. 2. The reference position of the port 72 is shown at 72A in FIG. 5. As the pump continues to rotate clockwise the piston will be tending to compress. The pump will rotate so that the port 72 for that pump will open to the opening 87 as represented at 72B in FIG. 5.

Pressure that is present in the pressure valving port 85 will be bled through the opening 87 and passageway 87A into the pump to precharge the piston and cylinder to equalize pressure. Because the opening 87 and its associated passageway 87A are controlled in size, they form a pressure drop orifice that presents a sudden surge of pressure into the pump (which is under low pressure) that is coming into position to open to the pressure valving port 85. This gradual precharge of pressure minimizes the noise of operation. As the cylinder and piston carrier continues to rotate, the port 72 for the reference pump will come into full communication with the valving port 85. As the shaft 11 rotates, the swash plate assembly including the piston carrier 43 which rotates in a plane at an angle to the cylinder carrier 24, will cause the piston to be pushed inwardly relative to its respective cylinder to force the fluid in the cylinder out through port 72 and into the valving port 85 under pressure, and thus out through the port 80 to the high pressure outlet. The rotation of the individual linear pumps is continuous, so there will be additional cylinders opening to the port 85 at the same time the reference pump cylinder is open to the port. Then, as the reference pump reaches the lower end of the port 85 the port 72 will seal against the surface 75, which is the surface of valve plate 19 facing the viewer in FIG. 5, and will be closed off from the pressure valving port 85. The reference cylinder assembly will be fully collapsed as shown in FIG. 2 at the lower portion of the figure. That is, the piston will be collapsed into its cylinder at this point of travel, and as the reference pump continues to rotate the cylinder will open to the opening 88, which is connected through the passageway 88A to the intake valving port 86 so that any differentials in pressure will be bled off. This will prevent any residual pressure in the reference cylinder from suddenly affecting the suction from other cylinder assemblies which are open to the intake valving port 86.

As the reference pump comprising a cylinder and piston assembly continues to rotate, the piston will be pulled outwardly from the cylinder, causing a partial vacuum, and therefore the cylinder will fill with fluid from the intake valving port 86 and port 81 until the reference pump again reaches the upper end of port 86 where the port 72 will again be closed off from port 86 and the cycle will repeat.

Each of the cylinder assemblies operates in this cycle, so that fluid under pressure is supplied to the port 80, through the pressure valving port 85, and hydraulic fluid is taken into the cylinder assemblies through the port 81 and the port 86.

The use of a separate valve plate 19 permits grinding the surfaces of the valve plate to close tolerances to insure adequate sealing capabilities, and as can be seen, the valve plate is easily held in place with the tubular spring pins 82 that also provide for drain passageways for the thrust bearing cavity in the cap 21.

It should again be noted that the cylinder openings leading to the respective ports 72 are the same diameter as the outside diameter of the piston. This opening continues without restriction all the way to the output end of the cylinder assemblies, even through the part spherical end portion 64, so that there is no restriction in the outlet of the cylinder that wastes power and reduces the output pressure. Further, intake flow is unrestricted as the cylinders are charged.

The pistons may have suitable grooves formed on their outer surfaces to reduce leakage and minimize binding.

Also, the valve plate may have an annular collector and drain passageway shown partially in FIG. 6 to permit leaking fluid to be collected and drained from between the sealing surfaces through radial passageways. As noted, the springy or wavy washers 70 will insure an axial sealing force between surfaces 74 and 75, and will take up any wear, and will compensate for slight movement of the cylinder assemblies during use to maintain adequate seals during operation.

The universal action swivel for the hub 40 and piston carrier ring is easily constructed, and is securely mounted in thrust bearings on the opposite sides of the disk 35 inside the slot 31 in shaft 11 so that wear problems are greatly reduced. The main thrust load from the pressure exerted on the cylinders and pistons is carried through the shoulder 25 integrally formed on the shaft, and then back to the snap ring 18 to the thrust bearing 16 so that the shaft 11 contains most of the reactive load from the cylinder assemblies.

It should be noted that the thrust bearings 46, 39 and 16 are all roller thrust bearings as distinguished from thrust collars that carry sliding members. The roller thrust bearings disclosed carry higher loads with less wear and friction than thrust collars, and there is no need for forced lubrication with the thrust bearings, particularly in regard to bearing 46 which transmits the thrust loads from the piston and piston carrier ring to the nonrotating housing 41.

Likewise, bearings 38, 42 and the bearings supporting the ends of pin 36 are roller or needle bearings, and not bushings.

The ball and socket type couplings at the ends of the pistons and cylinders minimize binding or cocking of the pistons as they move in the cylinders, and thus there is no need for placing bushings in the cylinders, or rigidly attaching the cylinders to the shaft.

What is claimed is:

1. A hydraulic pump or motor, comprising:

(a) a housing defining a fluid inlet and a fluid outlet;

(b) a shaft rotatably carried by the housing;

(c) reciprocating piston-cylinder pumping means;

(d) actuating means associated with the rotatable shaft for reciprocating the pumping means as the shaft rotates;

(e) valving means for alternately connecting the pumping means with the inlet and outlet as it reciprocates;

(f) and carrying means defining a socket for pivotally carrying a part of the pumping means relative to the valving means;

(g) the pumping means comprising (i) a cylinder member defining a cylindrical bore of constant diameter and open at both ends, the exterior surface of the cylinder member defining a partial spherical surface disposed in and carried by said socket;

(ii) and a piston member reciprocally disposed in the cylinder, the piston member being operatively connected to the actuating means.

2. The apparatus defined by claim 1, wherein the actuating means comprises a swash plate.

3. The apparatus defined by claim 1, which comprises a plurality of said pumping means, the carrying means defining a socket for each of said pumping means, and each being reciprocated by the actuating means.

4. The apparatus defined by claim 3, wherein the actuating means defines a socket for each pumping means, and the piston member of each pumping means defines a ball inserted into and pivotally carried by one of said actuating means sockets.

5. The apparatus defined by claim 4, wherein:

(a) the ball of each piston member is constructed to define a lubricating chamber within its associated socket;

(b) each piston member is hollow, opening toward the cylindrical bore to receive hydraulic fluid therefrom;

(c) and a restricted opening interconnects the lubricating chamber with the hollowed piston to receive lubricating fluid therefrom.

6. The apparatus defined by claim 3, wherein the actuating means reciprocates the plural pumping means in a sequential manner.

7. The apparatus defined by claim 3, wherein the pumping means are equiangularly spaced around the rotatable shaft.

8. The apparatus defined by claim 3, wherein:

(a) the carrying means comprises a carrier ring that rotates with the shaft;

(b) and the actuating means comprises a swash plate that rotates with the shaft.

9. The apparatus defined by claim 8, wherein the carrier ring is formed with a port of predetermined size for each pumping means, each port communicating with an associated cylinder bore; and the valving means comprises a stationary valve plate relative to which the carrier ring rotates, the valve plate defining inlet and outlet ports respectively communicating with the housing inlet and outlet, and to which the carrying ring ports are sequentially exposed.

10. The apparatus defined by claim 9, wherein the cylindrical bore of the cylinder member is greater in size than the associated carrier ring port.

11. The apparatus defined by claim 9, wherein the stationary valve plate further comprises orifice means associated with each of said inlet and outlet ports, each of said orifice means being disposed for rotational communication with each carrying ring port before the carrying ring port communicates with the valve plate inlet or outlet port, said orifice means being constructed and disposed to establish preliminary restricted fluid communication between each pumping means and the valve plate inlet or outlet, thereby reducing operational noise.

12. The apparatus defined by claim 9, wherein the carrier ring and valve plate define mutually engaging, flat sliding surfaces; and further comprising means for effecting a sealing relation therebetween.

13. The apparatus defined by claim 12, wherein the sealing means comprises a chamber disposed between the outlet side of each pumping means and the associated port, whereby fluid pumped from the pumping means will tend to urge the carrier ring toward the valve plate.

14. The apparatus defined by claim 13, wherein the sealing means further comprises resilient spring means disposed in said chamber between the outlet end of the pumping means and the carrier ring, the spring means being constructed and disposed to urge the carrier ring toward the valve plate.

15. The apparatus defined by claim 14, wherein the resilient spring means comprises a Belleville washer.

* * * * *